United States Patent [19]

Plumadore

[11] 4,202,619

[45] May 13, 1980

[54] ELECTROPHOTOGRAPHIC APPARATUS

[76] Inventor: John D. Plumadore, 83 Woodside Ter., Westfield, Mass. 01085

[21] Appl. No.: 938,695

[22] Filed: Aug. 31, 1978

[51] Int. Cl.[2] ..... G03G 15/00; G03G 15/10

[52] U.S. Cl. ..... 355/3 P; 355/10; 430/33

[58] Field of Search ..... 355/1, 3 R, 3 P, 10, 355/16; 96/1 PE

[56] References Cited

U.S. PATENT DOCUMENTS

| | | | |
|---|---|---|---|
| 2,752,833 | 7/1956 | Jacob | 355/10 |
| 3,582,205 | 6/1971 | Carreira | 355/3 P |
| 3,609,029 | 9/1971 | Egnaczak | 355/3 P |
| 3,684,362 | 8/1972 | Weigl | 355/3 R |
| 3,783,756 | 1/1974 | Friedel | 355/27 X |
| 3,834,803 | 9/1974 | Tsukada | 355/1 |
| 4,130,359 | 12/1978 | Groner | 355/3 P |
| 4,141,640 | 2/1979 | Roberts | 355/27 X |

*Primary Examiner*—Fred L. Braun

*Attorney, Agent, or Firm*—Chapin, Neal & Dempsey

[57] ABSTRACT

Apparatus for imaging electrophotographic film which has a short focal length optical gate for focusing a monochromatic light pattern onto the photoconductive layer of electrostatically charged film. The gate transmits and focuses the imaging light onto the film which is advanced over the surface of the optical gate while being lubricated by an optical liquid having an index of refraction closely matching that of the optical gate. The optical gate and liquid transmit and focus the images on the film at their point of contact. The optical gate may be a cylindrical rod which also may serve in part to define a reservoir for an electrophoretic liquid or toner which blends with the optical liquid adjacent the focal point of the optical gate.

16 Claims, 5 Drawing Figures

ELECTROPHOTOGRAPHIC APPARATUS

BACKGROUND

This invention relates to electrophotographic reproduction using thin transparent electrophotographic film wherein the photoconductor layer of the film is imaged using a suitable light conducting optical system. Generally, such electrophotographic systems include apparatus for developing latent electrostatic images by contacting the imaged film with an electrophoretic developer or "toner". The electrostatic image is generated in the film by applying to the photoconductor layer of the film a uniform electrostatic charge and exposing the charged surface to an imaging monochromatic light pattern which causes the charges to be dissipated in the illuminated areas of the film.

Electrophotographic apparatus conventionally employs a corona charging system which electrostatically charges the photoconductive layer of the film. For imaging the film is then exposed to monochromatic light from a suitable imaging device spaced from the film such as by a lens, mirror or the like. Usually the film is moved past a corona charging unit and thereafter an imaging unit and finally through a developing station which usually takes the form of a toning head in which the developer liquid contacts the film and the latent images are developed into visual images. Additional stations may be provided for "fixing" the toned image, or if desired, transferring the image from the transparent film to another substrate such as paper. While conventional electrophotography is electrically positive working in that high density images are produced where there is no light exposure, by reversal of toning techniques, electrophotography may be made negative working. In this connection, it has been found that better image quality results for scanned imagery when negative working material is used. This invention is readily adaptable for scanned imagery utilizing a galvo oscillograph, laser, so-called fax or oscillographs and/or fiberoptic CRT imaging systems, and preferably is negative working, ideally suited for this application.

Owing to the spacing of the optical system from the photoconductive surface of the film and the characteristics of the optical component found in conventional electrophotographic equipment, interference patterns are frequently caused by differences in the path lengths of light reflected at the interface of the air and photoconductive layer and at the interface between the photoconductive layer and base layer of the film. Since variations on the order of one-quarter wavelength can cause differences of exposure, elimination of this undesirable characteristic by coating the film is not feasible. Such interference patterns which often show up as a series of darkened lines or bands obscure and/or otherwise detract from the desired image and are, therefore, most undesirable.

It is a principal object of the present invention to provide an electrophotographic apparatus which overcomes the deficiencies of the prior art.

It is another object of the present invention to provide an electrophotographic apparatus wherein interference patterns from reflections off the surfaces of the photoconductive layer of the film are minimized.

It is a further object of this invention to provide apparatus of the above type which while overcoming the problem of interference patterns is also uniquely adapted for use with scanned imagery.

It is yet another object of the present invention to provide an electrophotographic apparatus which is adaptable for electrostatic charging and imaging using an integral component.

It is also an object of the present invention to provide an electrophotographic apparatus which is compact in size and effective in operation.

DESCRIPTION OF THE DRAWINGS

These and other objects will become more readily apparent from the following detailed description taken in connection with the accompanying drawings, in which.

DESCRIPTION OF THE PREFERRED EMBODIMENT

Figure 1:
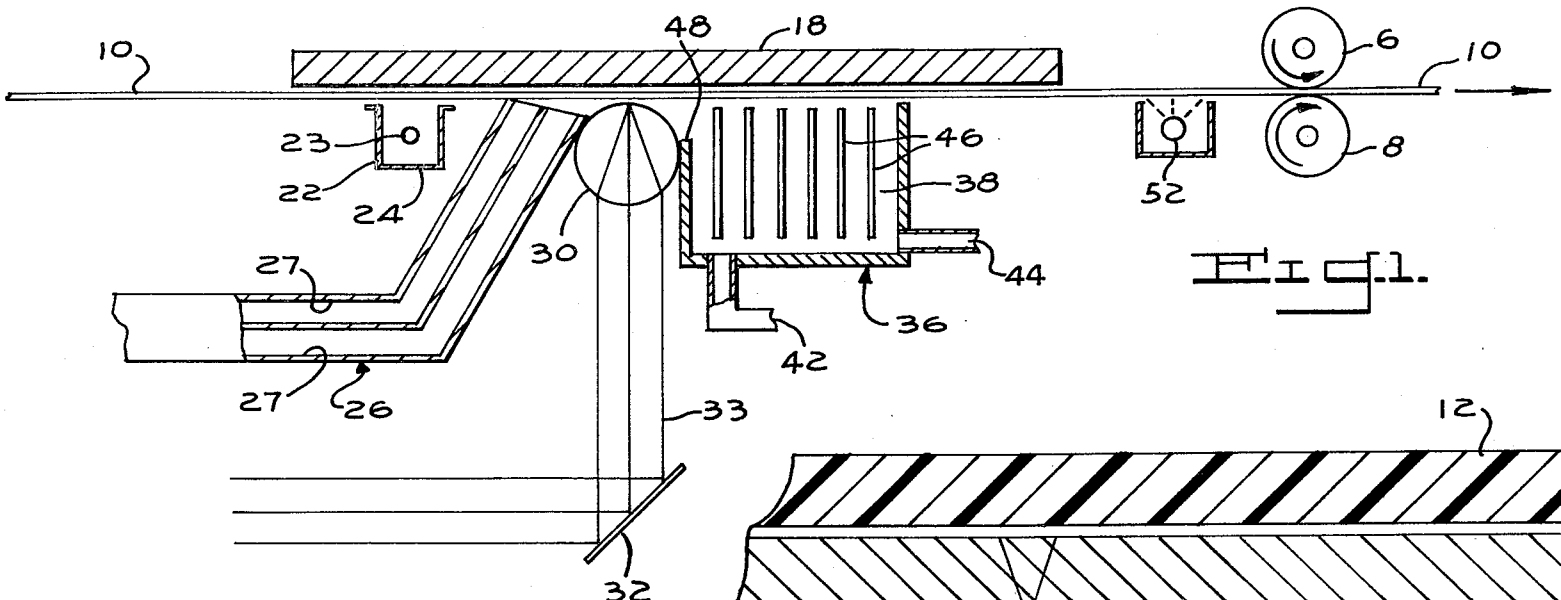
FIG. 1 is an elevational schematic view of electrophotographic apparatus of the type embodying this invention.

Referring in detail to the drawings, in FIG. 1 an electrophotographic processing unit of the type embodying this invention is shown in somewhat schematic form. The unit comprises film drive means in the form of pinch rolls 6 and 8, at least one of which is driven by a motor (not shown) for advancing a web or strip of electrophotographic film 10 through the successive steps of the film processing operation. The film 10 (FIG. 2) may be any suitable electrophotographic material which may be in the form of a strip, drum or belt. In the embodiment shown, it comprises a film base 12 such as a plastic layer coated with a conductive layer 14 which may be aluminum and a photoconductive layer 16 such as an organic photoconductor in solution with a resin binder forming an essentially transparent film.

The unit shown includes a backing plate 18 for accurately positioning the film during its processing and in certain installations the plate 18 may also serve for electrically grounding the film. As the film web or strip is drawn through the apparatus its photoconductive layer 16 is charged by a corona charging system 22, which as is shown comprises an electrically conductive wire 23 surrounded in spaced relation by a metallic electrode 24 causing the film to be electrically charged. The unit further includes means for wetting the surface of the film which as shown is in the form of a tubular conduit 26 having a plurality of longitudinal passages 27 through which optical liquid 28 (FIG. 2) is pumped for lubricating the film/lens interface. The optical liquid 28 is supplied so as to maintain the film 10 in a wet condition as it passes over a lens or optical gate 30 which focuses the imaging light onto the surface of the film. The outlet end of the conduit 26 preferably terminates in contiguous relation with the surface of lens 30 whereby a constant supply of optical liquid 28 (FIG. 2) wets and lubricates the lens and film for passage of the film over the convex upper surface of the lens 30 without danger of the film being scratched. The liquid also insures against the surface of the lens becoming dry during intermittent operations of the unit. Moreover, by adhering to the surface of the film, the liquid in effect provides a "liquid coupled optical gate" having a predetermined index of refraction. The optical liquid is chosen to approximate the optical properties (index of refraction) of the photoconductive layer and optical lens 30. In the preferred embodiment this liquid comprises a fluid hydrocarbon solvent of petroleum origin sold under the trademark ISOPAR by Humble Oil and Refining Co., or a polyhalogenated hydrocarbon containing fluorine and chlorine, marketed by E. I. duPont de Nemours and Co. under the trademark FREON. It has been found that when used in this manner, the optical fluid minimizes interference patterns in the photographic images ordinarily resulting from path length differences in light reflected at interfaces between the various optical components which have different refractive indices.

In the illustrative embodiment, a mirror 32 and optical element 30 focus the imaging rays of light 33 for high resolution reproduction along a line or narrow band of contact between the convexly curved surface of optical element 30 and film 10. The optical element 30 such as a fiber optical element or lens has a large effective aperture and for purposes of this application "effective aperture" is defined as the path length difference between the maximum angle of refraction of light transmitted through the optical element and unrefracted light. The optical element is said to have a large effective aperture or "focal length", in the case of a lens, when this path length difference is not less than $\frac{1}{8}$ wave length.

Figure 2:
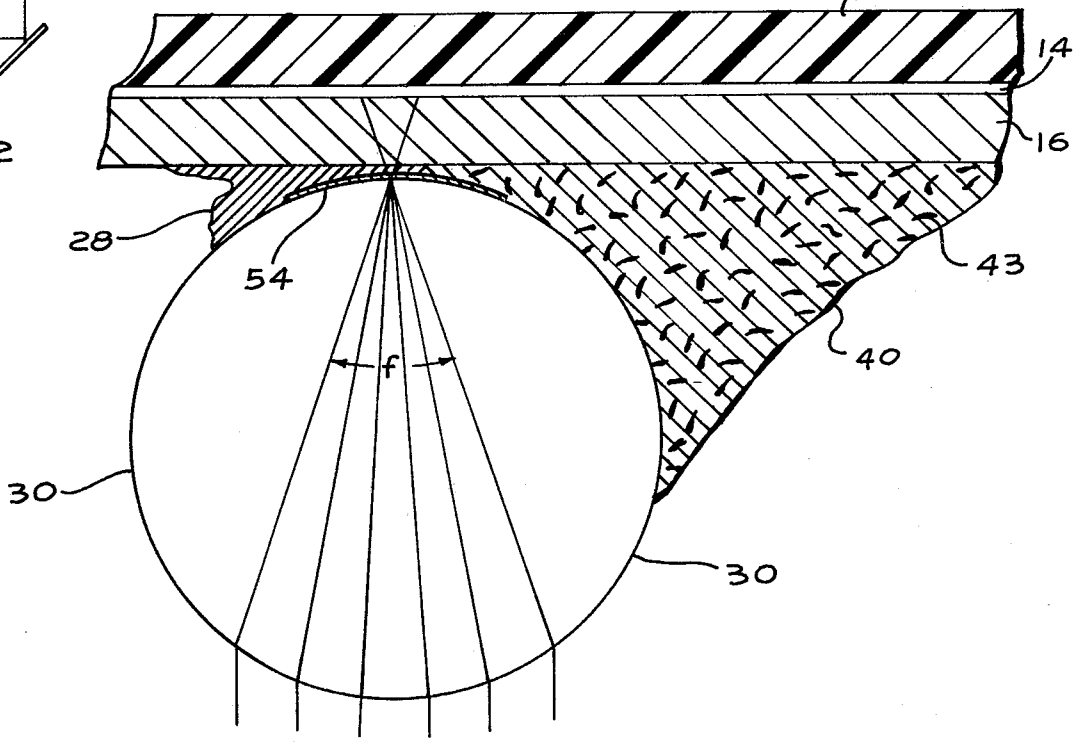
FIG. 2 is an enlarged elevational view showing the optical portion of the apparatus of FIG. 1.

In the embodiment illustrated in FIGS. 1 and 2, the lens 30 is in the form of an inexpensive cylinder or glass rod commercially available at cost in optical grade glass. The axis of the elongated rod is disposed transversely of the direction of movement of the film and has a length at least equal to the film width. The lens 30 having a short focal length sharply focuses the imaging light on the film 10 along a line extending transversely of the film web 10 whereby excellent image resolution is obtained. The wide angle of focus f of the lens minimizes the interference patterns recorded on the film because of differences in photoconductive layer thickness. Light, after passing through lens 30, is in effect composed of a variety of light rays transmitted at many angles. These light rays have different path lengths within the photoconductive coating. At a given point on the film, exposure is accomplished with internal film path lengths greater than $\frac{1}{4}$ wave of light thus, eliminating the effect of $\frac{1}{4}$ wave coating thickness variations by averaging the maximum and minimum interference modes. This interference or "photographic effect" between reflected light waves is further reduced by selecting an optical liquid 28 having an index of refraction closely matching or approximately equal to that of the lens 30 and photoconductive layer. By using such a liquid the reflection from the photoconductor/air interface is minimized. This further aids in allowing light rays transmitted through the lens at the widest angles to enter the film whereby its exposure energy approximately equals that of rays transmitted in a direction normal to the plane of the film. Thus interference is substantially reduced.

In addition to reducing light interference patterns, the lens 30 of elongated shape makes the apparatus of the present invention ideally suited for scanned imaging in which the image focused by the lens 30 is scanned longitudinally of the rod as web 10 is drawn thereover. Furthermore, the short focal length cylindrical lens 30 is relatively insensitive to scanning beam positioning errors, since it reduces such errors to substantially a single point or line on the film. Thus, in addition to the aforementioned benefits, problems with multiple facet scanners known as interfacet errors can be effectively reduced using this type of optical system.

After imaging, the film 10 passes over a developing or toning head 36 immediately following the cylindrical lens 30. As shown, the toning head comprises an upwardly opening tank or reservoir 38 for holding the developer or toning liquid 40 which comprises a dispersion of particles 43 (FIG. 2) in a liquid dispersant or carrier such as ISOPAR. Such a toner or electrophoretic developer may be pumped into the tank 36 by pipe 42 and drained by a second pipe 44. A series of closely spaced parallel plates 46 cause the toning liquid to contact the film over a sufficiently large area to insure proper image density. As shown, wall 48 of tank 36 abuts rod 30 so that a surface portion of the rod glass will serve as one wall portion of the toning head.

Toner 40 flows by capillary action into the nip between the lens 30 and photoconductive layer 16, the charged particles 43 being attracted to the opposite polarity electrostatic charge on the surface of layer 16, resulting from imaging of the film. This provides a photographic pigment image which is developed substantially simultaneously with and at the same location as light imaging of the film.

After leaving the toner head 36, the film is passed over a suitable heat source 52 for fixing the image, the heat causes the toner particles to fuse onto the photoconductor surface whereby the pigment image is made permanent.

In the preferred embodiment of this invention, an electrically conductive strip 54 (FIG. 2) is disposed longitudinally of the lens 30 on the surface thereof which is contacted by the films. The strip or electrode 54 is preferably formed from a layer of transparent tin oxide applied to the outer surface of the lens 30 by any suitable coating technique. The tin oxide coating is transparent to monochromatic light and may be applied as a narrow strip as shown in FIG. 2, or as a continuous peripheral layer 55 (FIG. 5) disposed about the outer surface of the lens 30.

With a combination lens-electrode optical element, the drawbacks of a separate corona element, as shown at 22, are overcome. Since the electrode coating 54 is in close proximity to the photoconductive layer 16 separated only by the optical fluid 28, the electrode is closely coupled to the film and operates with optimum efficiency because of minimum attenuation of the static electric field generated thereby. In addition, the thin layer of coupling liquid between the lens and film acts as a resistor and depending upon the resistive characteristics of the photoconductive film being used in the system may either allow substantial charge migration through the liquid or prevent said migration. For photoconduction requiring high electric field imaging and therefore high voltage on electrode 54, the liquid layer will attenuate this charge which migrates to the layer 16. For photoconduction requiring low electric field imaging, the charge migration through the liquid layer is minimal as compared with charges which will migrate through the photoconductive layer thus providing a system which will produce charges in the exposed areas of the film. Electrode 54 on the optical lens provides on demand imaging without the need for pre-exposed charging. Moreover, since the electrode 54 applies optical images simultaneously with the electrostatic charge, the adverse effects of charge instability due to migration or leakage during the elapsed time while the web is being moved from a separate corona charging zone to an imaging area are substantially reduced. Simultaneous charging, imaging and developing have been found to substantially reduce image deficiencies resulting from the time lag between generation of the electrostatic image and developing of the visual image.

Along the line of contact where film 10 is tangent to the lens 30, optical liquid 28 (FIG. 2) comes into contact with toner 40 and the two liquids must be chemically compatible. Inasmuch as this blending is in the imaging area, the two liquids should also be optically compatible, i.e., of the same or nearly same index of refraction. Preferably FREON or ISOPAR serves as the optical liquid 28 and also comprises the toner carrier liquid in which carbon black particles 43 or other suitable chargable particulate matter are dispersed. It has been observed under normal operating conditions, that the liquid layer in the nip between the electrode 54 and photoconductive layer 16 is so thin that imaging may be accomplished even where optical liquid 28 includes some toner particles in dispersion. Accordingly, for convenience and to assure chemical and optical compatibility between the wetting liquid and toner, the same liquid toner may be used for both functions. To this end, it has been observed that under conditions of low web velocity, developer 40 flows by capillary action upstream into the nip area between the film and lens so as to provide adequate lubrication without need of providing a separate optical liquid applicator upstream of the lens 30.

Subsequent to the toning of the image by toner particles 43, the image may be treated in any fashion known in the prior art. Thus it will be appreciated that the toned image may be transferred to a paper or other surface by any suitable means (not shown) or fixed by heat source 52 for preservation thereon.

Figure 3:
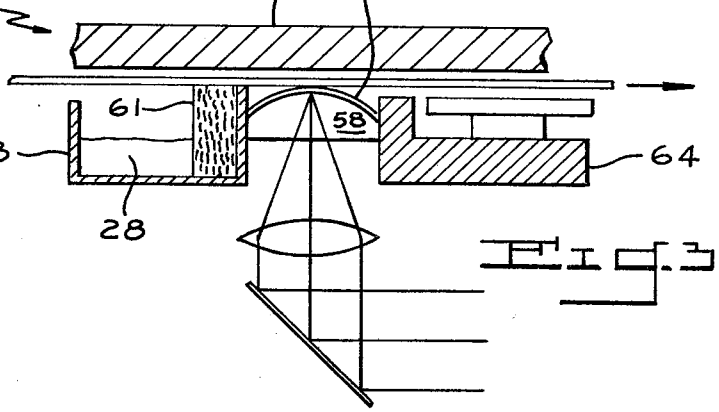
FIG. 3 is a fragmentary elevational view of an alternate embodiment of the apparatus.

Referring to FIG. 3, an alternate embodiment is shown at 50 and is substantially similar to the apparatus shown in FIGS. 1 and 2 but employs an optical gate or lens 58 of different cross sectional configuration. This image transmitting gate comprises an elongated plano-convex lens which may be coated on the convex surface thereof with a transparent electrically conductive material 59 such as tin oxide as discussed above. The coating may be overall or disposed in the form of a narrow strip or band located at or near the focal point of the lens 52. In accordance with the present invention, the lens has a relatively large aperture and short focal length for minimizing interference patterns. The system includes a wick 61 for wetting the film disposed within a reservoir 63 containing an optical liquid 28. A toner applicator is shown at 64.

Figure 4:
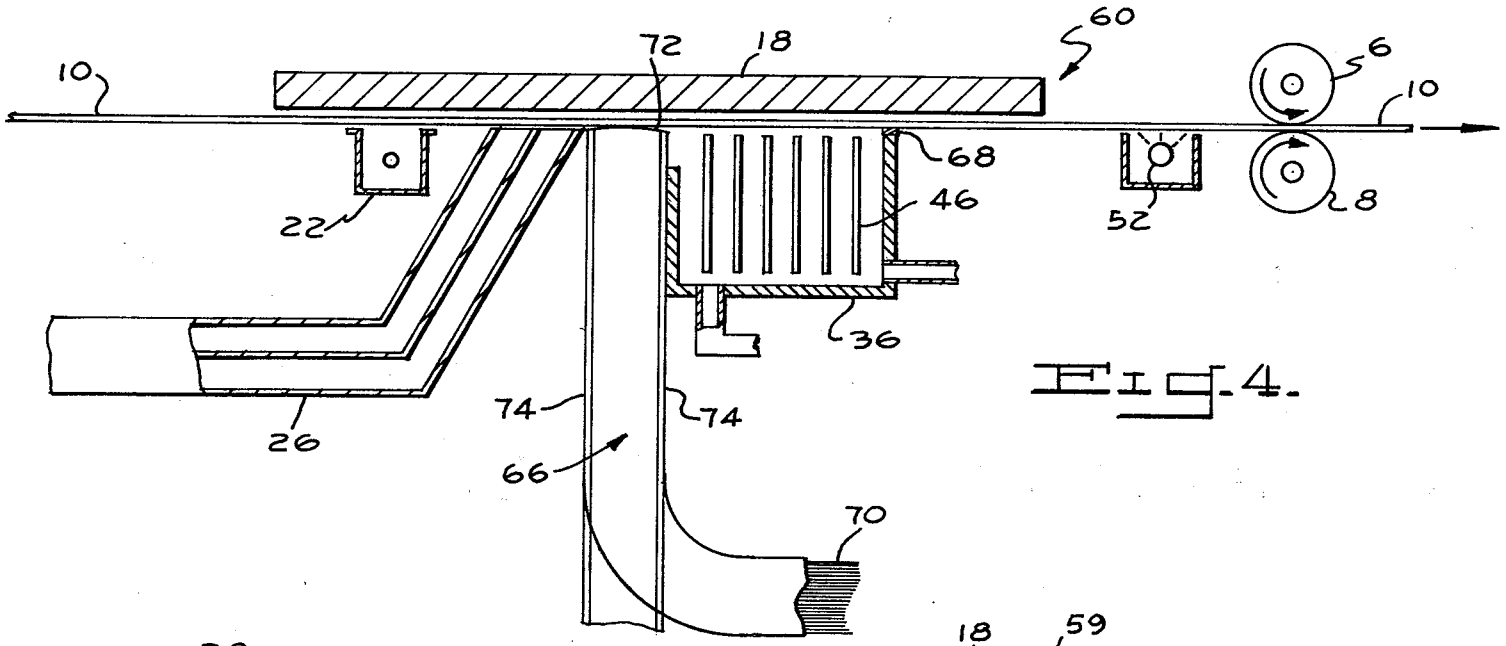
FIG. 4 is an elevational view of another alternate embodiment of the apparatus.

Referring to FIG. 4, another alternate embodiment of the present invention is shown at 60 and includes many of the components described in connection with FIG. 1 with like parts being assigned the same reference numerals. Apparatus 60 also includes feed rolls 6 and 8, back plate 18, an optional corona charging system 22 and a conduit 26 for wetting the web 10. An optical image transmitting means is shown at 66 and a toner chamber 36 is provided for developing the electrostatic image. An image fixing means 52 may also be provided as discussed above. The wetting, image transmitting and developing means function generally as the corresponding devices discussed hereinabove with respect to the first embodiment.

Wetting means comprises conduit 26 with two passages through which an optical liquid is pumped from a suitable source (not shown) into contact with photoconductive layer of the film. Pumping contact of the optical field is required where the web speed is of such magnitude as to prevent adequate wetting merely by means of contact with a wick.

Toning head 36 comprises apparatus by which developer is pumped into repeated contact with the photoconductive layer in the same manner as described in connection with FIG. 2. Baffles 46 channel the developer into repeated contact with the electrostatic image on the photoconductive layer. The developing means is sealed to web 10 at one end thereof by any suitable seal 68 and at the opposite end thereof by the upper surface image transmitting means 66.

Image transmitting means comprises an array or bundle of elongate optical fibers 70 which transmit light image portions longitudinally therethrough by means of repeated internal reflection therewithin. In the preferred embodiment, a narrow band or bundle of fibers arranged transversely to the direction of travel of the web is employed for transmission of a scanned image to the web as it is moved past the fiber optics array. Preferably, the end of the fiber bundle is given a convex configuration as shown at 72. This convex shape is conductive to the formation of a liquid layer between the film 10 and the fiber optic array. Metal coating or foil as shown at 74 may be disposed on each side of the fiber-optic bundle to which is applied the electric field to charge the conductor layer of the film 10. With this arrangement, the separate corona charging system 22 could be dispensed with. Alternatively, the ends of the fibers adjacent web 10 may be coated with tin oxide for providing an electrostatic charging electrode. Inasmuch as fiber optical image transmitting member 66 does not itself focus the image and thus may be quite thin, a charging electrode 74 may be carried adjacent the fibers in the form of a coating applied along one side of the adjacent fibers whereby the electrostatic charge is imparted to the film substantially simultaneously with the application of the optical image. In the latter construction, the electrode may be formed from a non-transparent substance such as metallic foil or tape. For purposes of symmetry, two electrodes 74, one disposed on either side of the fiber may be employed.

Figure 5:
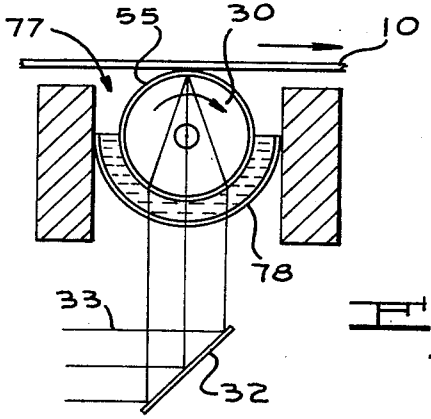
FIG. 5 is a view similar to FIG. 3 showing another alternate embodiment of this invention.

In FIG. 5, another embodiment of this invention is illustrated. A cylindrical lens 30 in the form of a rod is rotatably supported in a reservoir 77 for holding optical liquid or toner. This embodiment minimizes frictional drag on the film and the incidence of scratching caused by sliding contact of the film on the lens. The reservoir is provided with a transparent bottom wall 78 whereby light 33 for imaging the film 10 is transmitted directly through the reservoir, optical liquid and rotating lens 30. In this embodiment the lens is preferably coated with a transparent layer of tin oxide to provide an electrically conductive layer for electrostatically charging the film at about the same time as it is being imaged by the optical system.

While the apparatus of the present invention has been shown and described for producing one color images, it will be appreciated that this apparatus may be employed to duplicate multicolor images wherein a plurality of optical transmitting means are employed in a serial arrangement, each in conjunction with a toner of a particular color. Such transmitting means would be adapted to transmit a color-encoded image to a photoconductive layer which would then be imaged and developed in a specific color by an adjacent developing means.

Having thus described the invention, what is claimed is:

1. Electrophotographic apparatus comprising means for advancing a film strip having a photoconductive layer along a given path, means for electrostatically charging said photoconductive layer, an optical system for imaging and exposing the charge on said layer with monochromatic light, said optical system including a short focal length optical gate having a longitudinal axis disposed transversely of said path for surface engagement with the film strip being moved thereby, means for wetting the contiguous surface of the film and optical gate with a hydrocarbon based optical liquid during exposure of said film and a toning head for applying an electrophoretic liquid to the electrically imaged film for developing a visual image thereon.

2. Electrophotographic apparatus as set forth in claim 1 wherein said optical gate comprises a glass rod extending lengthwise across the path of movement of said film, said rod having a convexly curved surface disposed adjacent the photoconductive layer of said film, said optical liquid being applied to wet said film and said convex surface facing the input direction of said film strip, said toning head being adapted to apply an electrophoretic liquid to said convex surface facing in the output direction of said film relative to said gate.

3. Electrophotographic apparatus as set forth in claim 2 wherein the outer surface of said rod is coated at least in part with a transparent electroconductive layer.

4. Electrophotographic apparatus as set forth in claim 3 wherein said transparent electroconductive layer is a coating of tin oxide on the outer surface of said glass rod.

5. Electrophotographic apparatus as set forth in claim 1 wherein said optical gate includes a cylindrical glass rod.

6. Electrophotographic apparatus as set forth in claim 1 wherein said optical gate includes an electrically conductive transparent layer on the surface thereof adjacent said photoconductive layer for electrostatically charging said layer substantially simultaneously with the imaging of said film by light focused by said optical gate.

7. Electrophotographic apparatus as set forth in claim 1 wherein said electrophoretic liquid comprises a carrier liquid with a dispersion of particulate matter therein, said optical liquid being compatible with said carrier liquid and having approximately the same index of refraction as the optical gate and said carrier liquid.

8. Electrophotographic apparatus as set forth in claim 7 wherein said optical liquid is a polyhalogenated hydrocarbon.

9. Electrophotographic apparatus as set forth in claim 8 wherein said electrophoretic liquid comprises a polyhalogenated hydrocarbon containing a dispersion of carbon particles therein.

10. Electrophotographic apparatus as set forth in claim 1 wherein said optical gate is an elongated rod of planoconvex cross section having its convex surface disposed adjacent the film.

11. Electrophotographic apparatus as set forth in claim 1 wherein said optical gate serves as means for focusing monochromatic light images obtained by scanning said images longitudinally of said optical gate.

12. Electrophotographic apparatus as set forth in claim 1 wherein said optical gate is disposed on the underside of said film strip which has its photoconductive layer disposed adjacent said optical gate whereby said gate wetting with optical liquid is at least partially supportive of said film strip.

13. Electrophotographic apparatus as set forth in claim 1 wherein said optical gate is in the form of a rotatable cylindrical rod disposed to engage the photoconductive layer and rotate in synchronism with the film strip as it is moved thereagainst, said glass rod being disposed in a reservoir of an optical liquid and including a transparent wall portion adapted to transmit monochromatic light images onto the photoconductive layer of said film through said reservoir, optical liquid and glass rod.

14. Electrophotographic apparatus according to claim 1 wherein said electrophoretic liquid is applied to said imaged film generally at said contiguous surface such that said optical and toning liquids substantially meet at said optical gate.

15. Method of imaging electrophotographic film comprising the steps of transmitting monochromatic light through an optical element characterized by a large effective aperture through which the path length difference of light transmitted therethrough is not less than $\frac{1}{8}$ wave length, imparting relative movement between said film and optical component in contiguous relationship and optically coupling said optical element to the film with a light transmitting liquid during exposure of said film.

16. Method according to claim 15 wherein said optical element is coupled to said film by said optical liquid generally simultaneously with the toning of said image with an electrophoretic liquid.

* * * * *